United States Patent [19]

Trützschler

[11] 4,368,561

[45] Jan. 18, 1983

[54] APPARATUS FOR STRIPPING REVOLVING CARD FLATS

[75] Inventor: Hermann Trützschler, Monchen-Gladbach, Fed. Rep. of Germany

[73] Assignee: Trützschler GmbH & Co. KG, Monchen-Gladbach, Fed. Rep. of Germany

[21] Appl. No.: 164,557

[22] Filed: Jun. 30, 1980

[30] Foreign Application Priority Data

Jun. 29, 1979 [DE] Fed. Rep. of Germany ..... 2926261

[51] Int. Cl.[3] ..... D01G 15/78

[52] U.S. Cl. ..... 19/111

[58] Field of Search ..... 19/108, 109, 110, 111, 19/113, 102, 103

[56] References Cited

U.S. PATENT DOCUMENTS

| | | | |
|---|---|---|---|
| 11649 | 7/1891 | Ashworth et al. | 19/111 |
| 3,376,610 | 4/1968 | Williams | 19/111 X |
| 3,419,940 | 1/1969 | Vinogradov et al. | 19/111 |
| 3,604,061 | 9/1971 | King | 19/111 |

FOREIGN PATENT DOCUMENTS

| | | | |
|---|---|---|---|
| 1955775 | 4/1973 | Fed. Rep. of Germany . | |
| 467159 | 6/1914 | France | 19/111 |
| 318185 | 8/1929 | United Kingdom | 19/111 |
| 346186 | 4/1931 | United Kingdom . | |
| 714640 | 9/1954 | United Kingdom . | |
| 995488 | 6/1965 | United Kingdom | 19/111 |
| 175851 | 1/1966 | U.S.S.R. | 19/111 |
| 237030 | 6/1969 | U.S.S.R. | 19/111 |

*Primary Examiner*—Louis Rimrodt

*Attorney, Agent, or Firm*—Spencer & Kaye

[57] ABSTRACT

A carding machine has a main cylinder, revolving flats provided with clothing and moving along a circumferential portion of the main cylinder, a cleaning apparatus for cleaning the revolving flats and a suction device disposed underneath the apparatus for removing waste generated during operation of the cleaning apparatus. The cleaning apparatus comprises a flat stripping brush mounted for rotation adjacent the traveling path of the flats for cooperating with the clothing of the flats to remove waste therefrom, a brush cleaning roll mounted for rotation at a small distance from the flat stripping brush to continuously remove waste from the flat stripping brush and a waste collecting bin for catching waste thrown by the brush cleaning roll and for guiding the waste to the suction device.

5 Claims, 3 Drawing Figures

5
51
4'

61
6
3
11
82
7
4
2
81
8
83
1

APPARATUS FOR STRIPPING REVOLVING CARD FLATS

BACKGROUND OF THE INVENTION

This invention relates to an apparatus for cleaning (stripping) the traveling flats of a carding machine. Underneath the cleaning apparatus there is arranged a suction device for removing the waste generated during the cleaning operation.

The removal (stripping) of fiber material (flat strips) deposited in the clothing of the flats during carding is conventionally effected by a swinging flat stripping comb which is, by means of an eccentric, oscillated in front of the emerging, waste-filled flats, whereby a flat strip is combed out of the clothing of each flat bar. The individual flat strips are attached to one another by means of long fibers. The flat strips are pneumatically removed by means of a collecting and suction device disposed underneath the flat stripping comb.

Above the flat stripping comb there is arranged a rotating flat stripping brush which carries on its circumference an ejecting assembly comprising long teeth for the subsequent combing of the flat clothing. This ensures that shell fragments and other non-useable waste are removed. For removing the flat strips and the above-noted fragmented waste, there are thus required two components, that is, the flat stripping comb and the flat stripping brush. It is a disadvantage of such an arrangement that the flat stripping brush has to be cleaned very frequently, usually by hand. It is a further disadvantage that the flat stripping comb, because of its structure as an oscillating component, involves significant expense and is furthermore exposed to substantial wear.

SUMMARY OF THE INVENTION

It is an object of the invention to provide an improved apparatus of the above-outlined type which has a simplified structure and which provides for self-cleaning.

This object and others to become apparent as the specification progresses, are accomplished by the invention, according to which, briefly stated, there is provided a relatively slowly rotating flat stripping brush, the brush assembly of which is in engagement with the clothing on the flat bars and further, there is provided a relatively rapidly rotating brush cleaning roll, the brush assembly of which is arranged at a small distance from that of the flat stripping brush and further, with the brush cleaning roll there is associated a collecting device which directs the flat strips and other waste into the suction device.

By means of the flat stripping brush, there is achived simultaneously a removal of the flat strips and other waste from the clothing of the flat bars. This results in a significant structural simplification. By means of the brush cleaning roll, the flat stripping brush is continuously cleaned so that an uninterrupted operation may be maintained.

Preferably, the flat stripping brush has a brush assembly formed of pick-shaped brush elements. According to a further feature of the invention, the rotary speed of the flat stripping brush is higher than the revolving speed of the flats. Expediently, the brush cleaning roll is provided with a brush assembly formed of long bristles, for example, of steel wire. In accordance with a further preferred feature of the invention, the revolving speed of the brush cleaning roll is in excess of 450 m/min. According to a further advantageous feature of the invention, the collecting device has a stripper edge which is associated with the brush assembly of the brush cleaning roll. Preferably, the collecting device has a hollowed-out part for receiving and guiding the waste falling thereinto. In order to prevent waste hurled by the brush cleaning roll from entering between the flats, between the brush cleaning roll and the flat bars a protecting device such as a baffle guard is provided.

DESCRIPTION OF THE PREFERRED EMBODIMENTS

Figure 1:
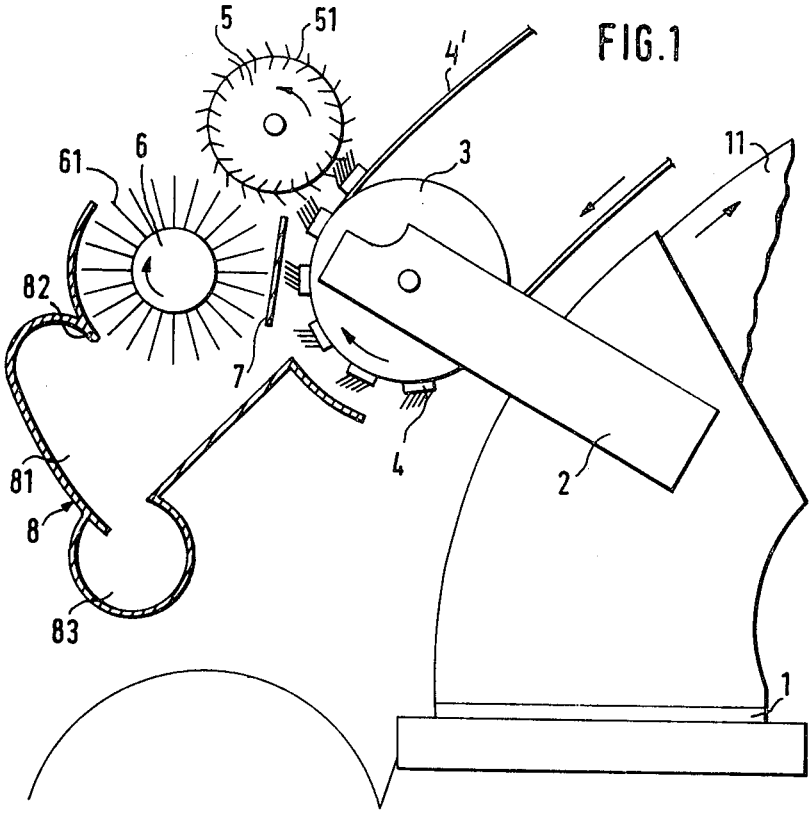
FIG. 1 is a schematic side elevational view of a preferred embodiment of the invention mounted at the inlet of a carding machine.

Turning now to FIG. 1, to a frame 1 of a carding machine, there is secured a bracket 2 supporting a flat carrier disc 3 about which flats 4, mounted on an endless flat chain 4' are conventionally guided. The removal (stripping) of flat strips accumulating in the flats 4 is effected by means of a rotary flat stripping brush 5 provided with a brush assembly 51 formed of pick-like elements. At a revolving speed of the flats of 120 m/min the flat stripping brush 5 is rotated at 6 r.p.m. which, in case of a brush diameter of 136 mm, results in a circumferential speed of 2564 mm/min. For cleaning the flat stripping brush 5, there is provided a rotary brush cleaning roll 6 whose brush assembly 61 is at a slight distance from the brush assembly 51 of the flat stripping brush 5. The brush cleaning roll 6 has an r.p.m. of 1350 which, in case of a roll diameter of 110 mm, corresponds to a circumferental speed of 466.5 m/min. Between the brush cleaning roll 6 and the flats 4 there is provided a baffle guard 7 which prevents thrown waste from entering between the flats 4. The brush cleaning roll 6 throws the flat strips into a suction device 8 which has a collecting bin 81. The latter has a stripper edge 82 which cooperates with the brush assembly 61 of the brush cleaning roll 6. The collecting bin 81 is, for receiving and guiding away the flat strips, of hollowed configuration, wherein the hollowed-out part extends from the stripper edge 82 to a suction channel 83. The hollow part of the collecting bin 81 is so oriented that the flat strips thrown by the brush cleaning roll 6 in the direction of the centrifugal force generated by the rotation of the brush cleaning roll 6, are caught by the above-described hollow part. FIG. 1 illustrates an embodiment in which the apparatus according to the invention is arranged at the inlet of the carding machine. The direction of rotation of the main cylinder 11 of the carding machine is opposite to the revolving direction of the working flight of the flats 4.

Figure 2:
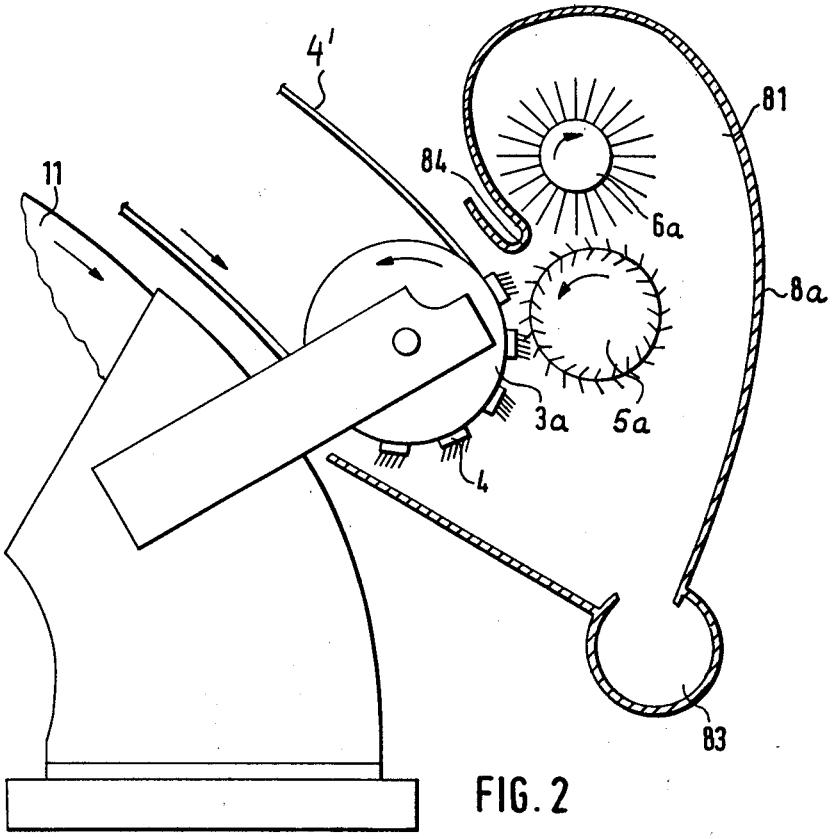
FIG. 2 is a schematic side elevational view of another preferred embodiment of the invention mounted at the outlet of the carding machine.

In FIG. 2 there is illustrated another preferred embodiment of the invention mounted at the outlet side of the carding machine. The main cylinder 11 of the carding machine rotates co-directionally with the working flight of the flats 4. With the flat carrier disc 3*a* arranged at the outlet (downstream) side of the carding machine there is associated a flat stripping brush 5*a* which rotates counterclockwise. Above the flat stripping brush 5*a* there is arranged a brush cleaning roll 6*a* which rotates clockwise. A suction device 8*a*, together with a collecting bin 81*a* is arranged about the flat stripping brush 5*a* and the brush cleaning roll 6*a* in such a manner that the flat strips and other waste fall exclusively into the suction device 8*a*. For this purpose, the collecting bin 81*a* is provided at one of its ends with a nose-like extension 84 which projects into the clearance between the brush cleaning roll 6*a* and the flat carrier disc 3*a*. The flat strips and other waste are thrown by the brush cleaning roll 6*a* in the direction of the centrifugal force into the collecting bin 81*a* and from there are conveyed into the suction device 83.

Figure 3:
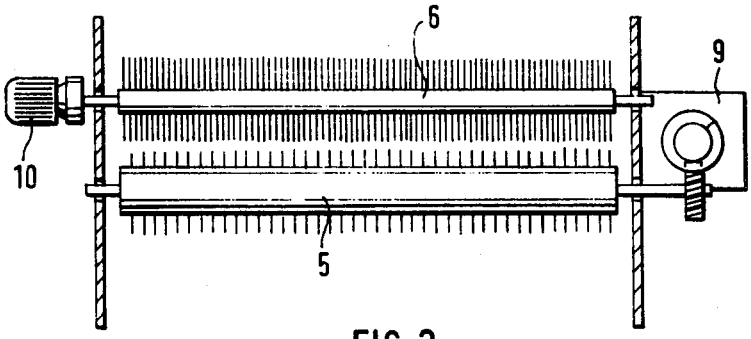
FIG. 3 is a front elevational view of some of the components forming part of the apparatus according to the invention.

Turning now to FIG. 3, the flat stripping brush 5 is driven by a gearing 9 which, at the same time, drives the flats 4 in a manner not shown. The brush cleaning roll 6 is driven by a drive 10, such as a motor. It is noted that the structure illustrated in FIG. 3 is applicable to the embodiments of both FIG. 1 and FIG. 2.

It will be understood that the above description of the present invention is susceptible to various modifications, changes and adaptations, and the same are intended to be comprehended with the meaning and range of equivalents of the appended claims.

What is claimed is:

1. In a carding machine including a main cylinder, revolving flats provided with clothing and moving along a circumferential portion of the main cylinder, a cleaning apparatus for cleaning the revolving flats and a suction device disposed underneath said apparatus for removing waste generated during operation of the cleaning apparatus; the improvement in said cleaning apparatus comprising (a) a flat stripping brush mounted for rotation adjacent the traveling path of said flats for cooperating with the clothing of the flats to remove waste therefrom; said flat stripping brush having a brush assembly;

(b) a brush cleaning roll mounted for rotation and having a brush assembly arranged at a small distance from the brush assembly of said flat stripping brush to continuously remove waste from said brush assembly of said flat stripping brush;

(c) a waste collecting means for catching waste thrown by said brush cleaning roll and for guiding the waste to said suction device; and (d) a stripping edge forming a part of said waste collecting means and cooperating with the brush assembly of said brush cleaning roll.

2. A carding machine as defined in claim 1, wherein the brush assembly of said flat stripping brush is formed of pick-shaped elements.

3. A carding machine as defined in claim 1, wherein the brush assembly of said brush cleaning roll is formed of long bristles.

4. A carding machine as defined in claim 1, wherein said waste collecting means includes a hollowed-out part for catching and guiding waste thrown by said brush cleaning roll.

5. A carding machine as defined in claim 1, further comprising a baffle guard disposed between the flats and the brush cleaning roll for preventing waste from being thrown by the brush cleaning roll into the flats.

* * * * *